United States Patent [19]

Hibbard et al.

[11] Patent Number: 4,550,785

[45] Date of Patent: Nov. 5, 1985

[54] HAMMER

[75] Inventors: George A. Hibbard, Claremont; Ward D. Morrison, South Acworth, both of N.H.

[73] Assignee: Consolidated Technologies Corporation, Denver, Colo.

[21] Appl. No.: 43,089

[22] Filed: May 29, 1979

Related U.S. Application Data

[63] Continuation-in-part of Ser. No. 680,823, Apr. 28, 1976.

[51] Int. Cl.[4] ..... B25D 9/00

[52] U.S. Cl. ..... 173/134

[58] Field of Search ..... 173/1, 134, 138, DIG. 4; 91/5, 12, 232, 235; 251/324

[56] References Cited

U.S. PATENT DOCUMENTS

| | | | |
|---|---|---|---|
| 1,424,156 | 8/1922 | Clark | 91/232 |
| 3,004,523 | 10/1961 | Christensen | 173/138 |
| 3,322,038 | 5/1967 | Dobson | 173/DIG. 4 |
| 3,322,210 | 5/1967 | Arndt | 173/134 |
| 3,371,726 | 3/1968 | Bouyoucos | 173/134 |
| 3,620,312 | 11/1971 | Krasnoff | 173/DIG. 4 |
| 3,741,072 | 6/1973 | Romell et al. | 173/DIG. 4 |
| 3,887,019 | 6/1975 | Reynolds et al. | 173/DIG. 4 |
| 3,903,972 | 9/1975 | Bouyoucos et al. | 173/DIG. 4 |
| 3,916,764 | 11/1975 | Crover | 173/DIG. 4 |

FOREIGN PATENT DOCUMENTS

| | | | |
|---|---|---|---|
| 801491 | 12/1968 | Canada | 173/134 |
| 848871 | 9/1960 | United Kingdom | 251/324 |

OTHER PUBLICATIONS

Ernst, *Oil Hydraulic Power & Its Industrial Applications*, p. 35, Jan. 1960.

Vennard, *Elementary Fluid Mechanics*, pp. 329–331, Oct. 1948.

*Primary Examiner*—Lawrence J. Staab

[57] ABSTRACT

A hydraulically operable hammer and more particularly a hydraulically operable hammer having improved cycling of a hammer piston reciprocable therewithin.

11 Claims, 7 Drawing Figures

HAMMER

This application is a continuation-in-part of the copending application Ser. No. 680,823, filed Apr. 28, 1976.

It is well known in the art of rock drills to provide a drill assembly with a fluid actuated hammer comprised of a linear percussion motor of the valveless distribution type wherein a hammer piston is self-excited for rapid linear reciprocation to repetitively impact a striking member for the purpose of drilling rock or other hard formations.

Although such drills have generally served the purposes intended, they have nonetheless been subject to various deficiencies. For example, some such drills have been subject to unduly inefficient transfer of mechanical energy from the hammer to the striking member. Some prior hammers have been extremely sensitive to small changes in such parameters as fluid supply pressure or temperature, or location of the striking member impact end, and have thus been impractical for reliable day-to-day field use. Fluid cavitation of hydraulic fluid passing from a high pressure to a low pressure state has been a further problem in many prior art hydraulic hammers. Other hammers have been very difficult to start. Still other hammers have been of bulky and cumbersome design, and excessively difficult and expensive to manufacture.

Hydraulic hammers have also required a long preconditioning period before the hammer can be used in environments where the hydraulic fluid for operating the hammer drops to a temperature such that the fluid viscosity is too high to properly actuate the hammer element. Such high viscosity situation is particularly troublesome in situations where the entire hammer assembly is left outdoors overnight in cold environments.

These and other shortcomings of prior hammers are alleviated by the instant invention according to which there is provided an improved and simplified hydraulic hammer of the valveless or self-actuating type and which is also easily conditioned for operation under cold weather conditions.

Generally, the objects of this invention are to provide:

(a) a hydraulically operable self-porting hammer of compact and simplified design;

(b) an improved operating cycle for a hydraulically operable hammer;

(c) a hammer having improved and simplified startup characteristics;

(d) a hammer piston having a longer useful life than ordinarily obtainable;

(e) a hammer having improved efficiency of impact energy transfer;

(f) a hammer having improved means to preclude pressure and fluid accumulations within portions thereof not intended to contain such pressure and fluid accumulations.

A more specific object of this invention is to provide a hammer wherein control valve means is operable to effect movement of the hammer piston to a starting position in its stroke from which self-excited piston reciprocation is readily achieved upon introduction of motive fluid flow thereto.

Another specific object of this invention is to provide a hammer in which the efficiency of operation is insensitive to comparatively large variations in the location of the striking end of the impact receiving member.

Yet another specific object of this invention is to provide a hammer wherein the dwell time during which the hammer piston contacts the striking element during impact is extended over that of known hammers.

A more specific object of this invention is to provide a hammer having fluid energy absorbing or accumulating means communicating with the upstroke and downstroke sides of the hammer piston.

Another more specific object of this invention is to provide a hammer having a hammer piston formed to control exhaust fluid flow.

Another object of this invention is to provide a hammer in which the hammer element has integral means for permitting warm up of the operating fluid under start up conditions.

Still another object of this invention is to provide a hammer in which the hammer element has integral means for permitting warm up of the operating fluid under start up conditions which are functionless during reciprocation of the hammer element in its normal operating mode.

An additional object of this invention is to provide a hammer piston which is selectively reversible in the piston bore such that either end thereof may be used for impacting; if desired such reversing of the hammer piston may also provide for selective varying of the hammer operating cycle.

These and other objects and advantages of the instant invention are more fully specified in the following description with reference to the accompanying figures in which.

Figure 1:
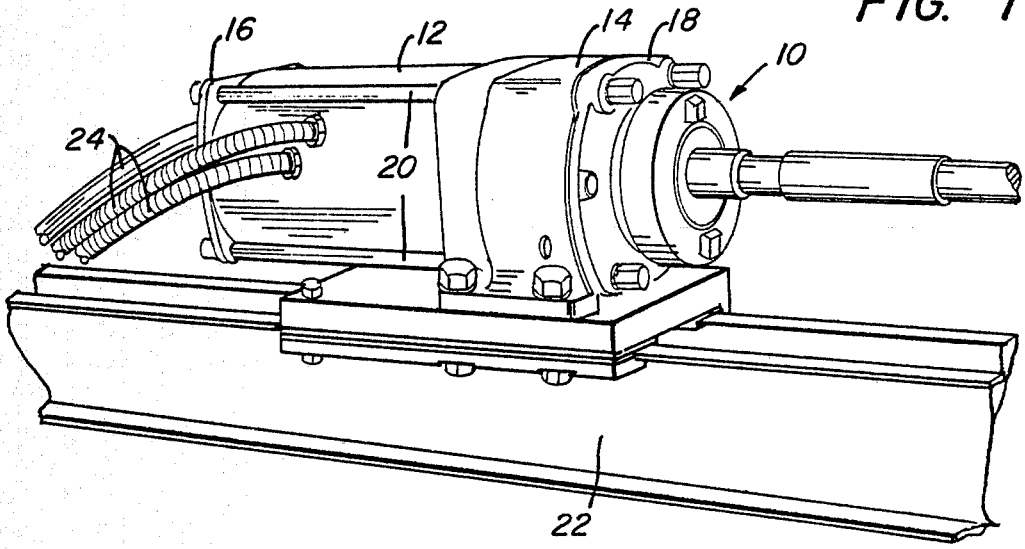
FIG. 1 is a perspective view of a rock drill including hydraulically actuated hammer means constructed according to the principles of this invention.

In FIG. 1 a hydraulically actuated rock drill assembly 10 comprises a percussion head or motor portion 12 coaxially engaging a forward yoke portion 14. Suitably disc-like backhead and front head members 16 and 18 coaxially engage the rearward end of percussion head 12 and the forward end of yoke 14, respectively. Securing means such as a plurality of longitudinally extending side rods 20 rigidly clamp the hereinabove identified drill portions together to form the unitary drill assembly 10. Drill 10 is reversibly feedably mounted on an elongated feed frame 22, which frame 22 is in turn adjustably carried by any suitable mobile base such as a crawler frame and articulated boom assembly (not shown), and is supplied with motive fluid by suitable fluid hoses 24 communicating with drill 10 to actuate the drill 10 as hereinbelow described.

The yoke portion 14 (FIG. 2) comprises a generally annular yoke housing 28 having a generally annular, elongated chuck member 30 axially rotatably carried therewithin as by roller bearings 32. Chuck member 30 includes a plurality of circumferentially spaced gear teeth 34 coaxially encompassing an axially intermediate external peripheral portion thereof for engagement with a driving gear train (not shown) carried within housing 28 for rotation of chuck 30 as described hereinbelow.

The chuck 30 carries coaxially therewithin an elongated annular rear bushing member 38 and an elongated annular drive member 40 forwardly adjacent bushing 38. Bushing 38 and drive member 40 are coaxially aligned with an annular forward bushing 46 secured within an inner peripheral portion 48 of front head 18 as by a nut 50 coaxially threadably engaging front head 18 whereby an elongated, generally cylindrical striking bar 42 extending coaxially within chuck member 30 and front head 18 has its axially opposed end portions longitudinally slidably supported within inner peripheral portions 44 and 45 of bushings 38 and 46, respectively. An externally splined intermediate portion 54 of striking bar 42 extending intermediate the respective supported end portions thereof is engageable within a cooperably splined internal peripheral portion 56 of drive member 40, and drive member 40 is non-rotatably splined to chuck 30 as at 58. Accordingly, striking bar 42 is axially rotatable as by a suitable rotation motor such as a pressure fluid actuated motor 36 which receives motive fluid through suitable supply lines (not shown) to drive the chuck and striking bar assembly in coaxial rotation through the above-mentioned gear train.

As indicated hereinabove striking bar 42 is axially slidable within chuck 30. In its extreme rearward position (FIG. 2) defined by abutment of cooperably formed, respective end portions 62, 66 of striking bar intermediate portion 54 and bushing 38, a rearwardmost end or impact surface 68 of striking bar 42 is positioned adjacent the forward end of percussion head 12 to receive impact blows therefrom. Inasmuch as the hereinabove described yoke portion 14 forms no part of the present invention and is well known to those versed in the relevant arts, further detailed description thereof is omitted herefrom.

Figure 3:
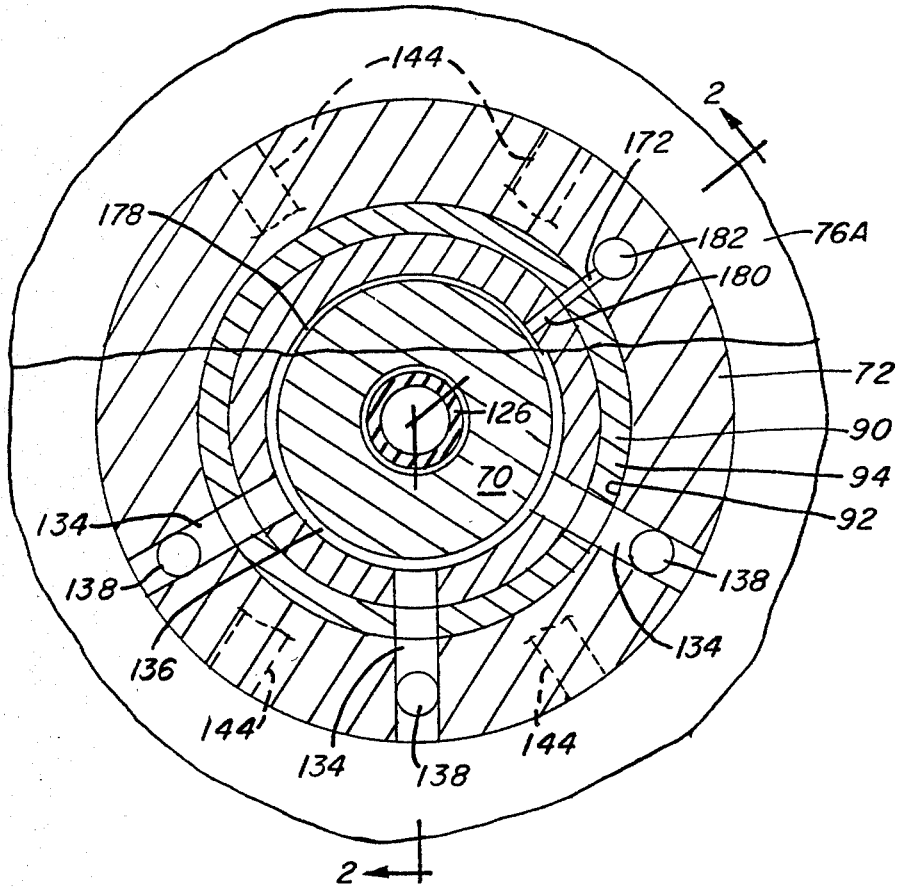
FIG. 3 is a transverse section taken on line 3—3 of FIG. 2.

Percussion head 12 (FIGS. 2 and 3) comprises an elongated formed member or cylinder 72 such as a machined steel casting, and an elongated cylindrical shell 74 coaxially rigidly encompassing cylinder 72 and axially coextensive therewith. Percussion head 12 has a plurality of chambers 76A through 76D, hereinafter collectively identified as chambers 76, and preferably formed as a plurality of axially spaced and aligned annular cavities 78 extending radially inwardly of the exterior periphery of cylinder 72 whereby an adjacent inner periphery 80 of shell 74 forms the radially outermost wall of the chambers 76. The chambers 76 are axially spaced apart by intervening radially outwardly extending partitions 82, each having an outer annular periphery 84 which sealing engages the inner periphery 80 of shell 74 to preclude fluid communication between adjacent chambers 76. Other radially outwardly extending partitions 82 are formed adjacent the forward and rearward axial end portions of cylinder 72 to sealingly engage respective axial end portions of periphery 80 thereby defining the outer or end walls of the end chambers 76A and 76D, respectively.

Shell 74 and cylinder 72 are preferably assembled by a shrink fitting process as by being initially formed for an interference fit therebetween at ambient temperature. For assembly the shell 74 is heated and/or the cylinder 72 cooled to thermally produce a diametrical clearance therebetween. After assembly the shell 74 and cylinder 72 equalize to ambient temperature to dimish the diametrical clearance therebetween and provide a continuous, fluid tight face seal as described without recourse to known elastomeric sealing members and the like.

Cylinder 72 has an elongated annular liner assembly 90 retained within a stepped coaxial through bore 92 thereof and comprising an elongated member or sleeve 94 and an elongated buffer ring 102 coaxially disposed within a rearward end peripheral portion 100 of sleeve 94. The coaxially communicating inner peripheries of buffer ring 102 and sleeve 94 define a coaxial through bore 88 wherein an elongated, stepped cylindrical piston 70 is axially reciprocably disposed.

Bore 88 has respective axially spaced forward and rearward bearing portions 96, 104 which slidably support therewithin respective axially spaced forward and rearward stem portions 98, 98' of piston 70. An enlarged diameter intermediate portion 106 of the bore 88 extending intermediate the respective bearing portions 96, 104 has disposed therewithin a generally stepped cylindrical intermediate or head portion 108 of piston 70. Respective variable volume upstroke and downstroke piston driving chambers 110, 112 are formed adjacent respective forward and rearward ends of piston head 108 by axially spaced annular peripheral clearance spaces between the head 108 and bore portion 106. Piston 70 is cooperable with bore 88 to provide for porting of pressurized motive fluid alternately to and from driving chambers 110, 112 for self-excitation of the piston 70 as described hereinbelow.

Backhead 16 is rigidly clamped by side rods 20 adjacent the rearward end of percussion head 12 in compressive axial engagement with suitably formed bearing surface portions of percussion head 12, for example coaxial bearing annuli 114 and 116 formed by rearwardly facing axial end portions of the cylinder 72 and shell 74, respectively. Backhead 16 similarly engages the rearward end 118 of buffer ring 102 which, in turn has a forward end portion 120 thereof, axially engaging a cooperable, annular, rearwardly facing shoulder 122 formed upon the inner periphery of sleeve 94. Sleeve 94 seats within a rearward end portion of bore 92 by engagement of cooperably axially abutting shoulder portions formed on respective adjacent peripheral portions thereof as at 124 whereby the applied clamping forces of side rods 20 serve to rigidly seat liner assembly 90 within bore 92. The sleeve 94 and buffer ring 102 furthermore are non-rotatably affixed with respect to each other and cylinder 72 as by suitable keys or shear pins (not shown) fitted into cooperably formed keyways.

The drilling apparatus 10 further comprises a flushing fluid means generally indicated at 11 and comprising a tube 126 disposed within suitably formed delivery passageways extending coaxially within backhead 16, piston 70 and striking bar 42, and including a fluid inlet 128 in backhead 16 for directing flushing fluid such as air or water thereinto for cleaning detritus from the bore hole. A full description of the flushing fluid means 11 may be found in copending application Ser. No. 625,540, filed Oct. 24, 1975 which is assigned to the same assignee as the instant invention.

Drilling apparatus 10 has fluid supply means as follows for delivery of motive fluid to actuate piston 70. A motive fluid inlet connection 130 extends radially through shell 74 for communicating an external source of motive fluid flow such as a constant flow pump 132 via a fluid line 134 into chamber 76A which is of a volume to provide a reservoir of pressurized motive fluid for delivery to the upstroke and downstroke driving chambers 110, 112. When motive fluid is supplied to the respective driving chambers 110, 112 the fluid response is supplied primarily by the chamber 76A whereby the percussion head 12 need not depend directly on pump 132 for immediate fluid flow response and large pressure fluctuations in the supply line 134 are thus avoided. During inlet deadband cycle portions (to be described hereinbelow) when all fluid inlets to the chambers 110, 112 are closed, pump 132 recharges chamber 76A for the next fluid inlet opening. Chamber 76A communicates by means of a plurality of circumferentially spaced and generally radially extending bores 134 with a downstroke inlet annulus 136 extending radially outwardly of bearing portion 104 axially rearwardly of the bore portion 106. The radial bores 134 are intersected by a respective plurality of axially extending passages 138 in cylinder 72 which in turn communicate via another plurality of radially extending bores 140 with an upstroke inlet annulus 142 extending radially outwardly of bore portion 96 axially forwardly of bore portion 106 whereby fluid communication between chamber 76A and the respective inlet annuli 136, 142 is constantly maintained. Similarly, the annular chambers 76B and 76D are in continuous fluid communication with the downstroke and upstroke driving chambers 112, 110 via axially spaced pluralities of circumferentially spaced and generally radially extending bores 144, 146, respectively, to provide respective downstroke and upstroke fluid energy accumulators for storing and releasing fluid pressure energy as described hereinbelow, and the remaining chamber 76C communicates via a similarly disposed plurality of radially extending bores 148 with an exhaust annulus 150 extending radially outwardly of bore portion 106 intermediate the axial ends thereof. The volume of chambers 110 and 112 and the associated chambers 76D, 76B is variable by movement of piston 70 alternately into and out of the chambers 110, 112. The percent volume variation is quite small, for example in the range of a fraction of 1% to approximately 5% in view of the limited compressibility of hydraulic fluids. The limits of percent volume variation may vary depending upon the particular fluid to be used. The respective pluralities of radial bores 144, 146 and 148 are circumferentially spaced intermediate the axial passages 138 (FIG. 3) to provide proper fluid flow as described.

Preferably, all of the respective pluralities of radially extending bores 144, 146 and 148 are spaced evenly about the circumference of cylinder 72 whereby the fluid flow therethrough to and from bore 88 produces no net side loading or torque upon the piston 70. Accordingly, piston 70 may readily be rotated by an externally applied rotational impetus supplied for example by the rotating striking bar 42 during contact thereof with piston 70 at impact. Rotation of piston 70 within liner assembly 90 induces rotary viscous shear forces to provide a hydrodynamic lubricant film between the relatively rotating elements thereby improving the efficacy of piston lubrication to reduce wear and friction during piston reciprocation. Additionally, the absence of torque and side loading on piston 70 as described permits continuing piston rotation during cycle portions between impact. To the extent that piston 70 is rotating concomitantly with striking bar 42 as each impact is initiated, the wear factor attributable to relative rotation between such impacting members during contact will be reduced. An exhaust outlet connection 152 communicates radially through shell 74 with exhaust chamber 76C and has a fluid line 154 connected thereto whereby exhaust fluid may be directed to a suitable fluid reservoir 156.

Because piston 70 (FIG. 4) is symmetrical about its medial transverse plane P—P, only one axial half portion of the illustrated piston, i.e., the upstroke half, will be described. The remaining piston half portion, i.e. the downstroke half, is the mirror image of the upstroke half. The reference characters applied to the downstroke half are primed characters to correspond to the hereinbelow described parts of the upstroke half of piston 70. The head portion 108 of piston 70 comprises a central, axially extending annular land 158 axially slidable within bore portion 106 in cooperation with exhaust annulus 150 to provide exhaust porting or valving during piston reciprocation. A land 162 is formed with its largest diameter end portion 160, which is smaller than the diameter of land 158, located adjacent the axial end of land 158 and tapers radially and inwardly therefrom along its axial extent at a taper angle with respect to the central longitudinal axis of piston 70 in the range of about 5° to about 15°, preferable 10°, to provide controlled porting of exhaust fluid by uniformly increasing the outflow of pressure fluid to exhaust as the exhaust annulus 150 opens. Land 162 thereby reduces the possibility of undesirable fluid cavitation which might occur as a result of uncontrolled fluid pressure release to the exhaust. Additionally, the taper on land 162 tends to promote non-turbulent flow of pressurized fluid from the respective driving chambers 110, 112 to the exhaust as piston head 108 alternately moves into each chamber 110, 112 during reciprocation, thereby reducing the tendency of the fluid within chambers 110, 112 to retard piston movement thereinto.

Figure 2:
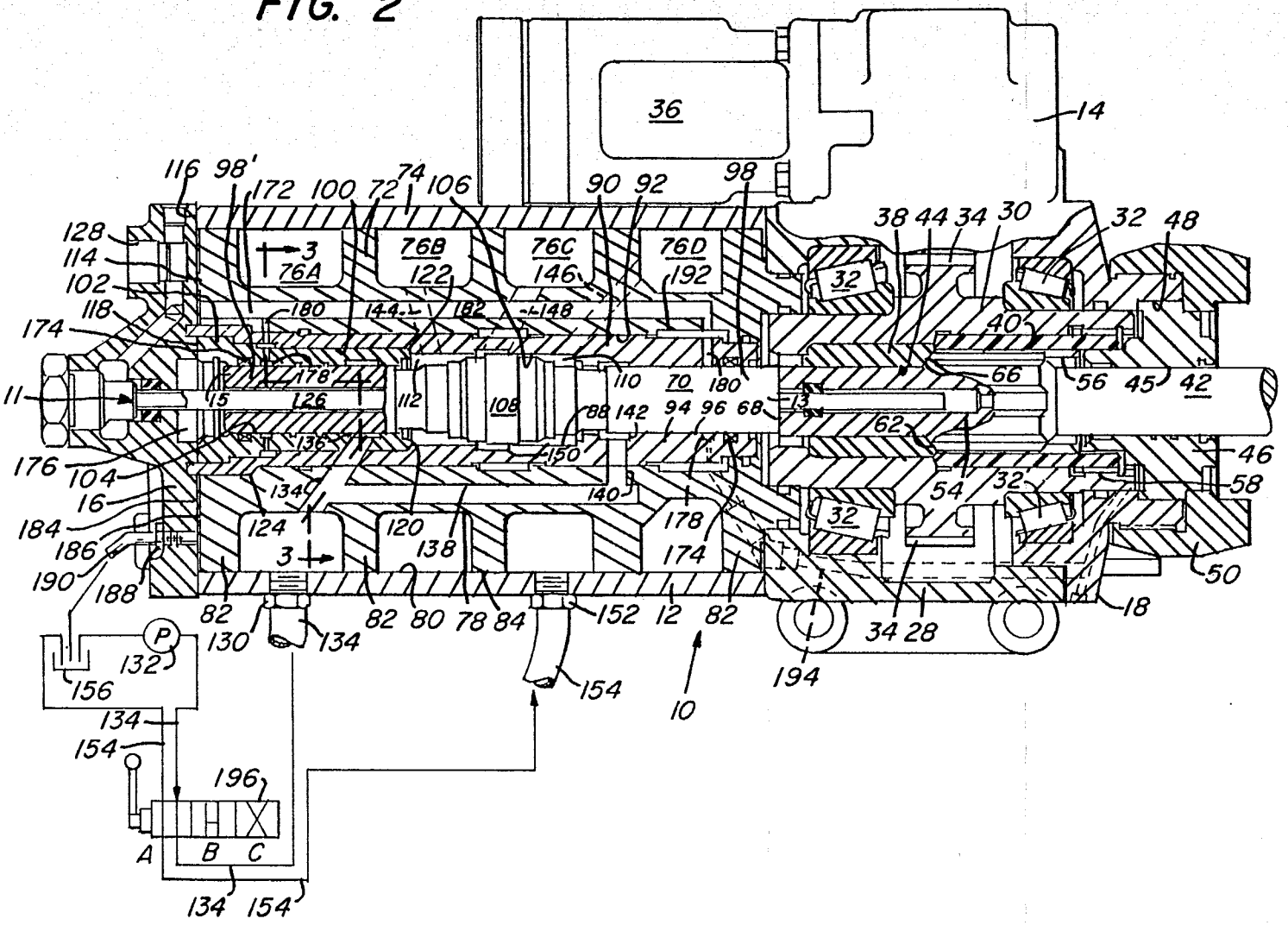
FIG. 2 is an axial section of the drill shown in FIG. 1 and taken on line 2—2 of FIG. 3.

Axially spaced from the outer axial end of land 162 is an annular land 166 cooperable with an annular cavity 168 formed adjacent the interface of bore portions 106 and 96 to provide a fluid cushion in the event of excess piston over-travel during reciprocation. Extending axially intermediate the axially adjacent ends of lands 162 and 166 is an intervening portion 164 which may be formed with a uniform or a tapering diameter, depending upon the respective diameters of the portions of lands 162 and 166 joined thereby. Land 166 extends axially outwardly to terminate adjacent the stem portion 98. A radially inwardly extending annular inlet groove 170 is formed in stem portion 98 intermediate the axial ends thereof for providing fluid inlet porting or valving during piston reciprocation in cooperation with inlet annulus 142. The stem portion axially inward (or rearward) of groove 170 functions primarily as an inlet valve seat in cooperation with the respective portion of bearing portion 96. The portion of stem 98 axially outward (or forward) of groove 170 is cooperable with the remainder of bearing portion 96 for slidably supporting the piston 70 within bore 88. With the symmetrical piston 70 as described, the drill 10 may be assembled with either end of the piston 70 forward whereby an extended piston life is obtainable by reversing the piston 70 when the impact end thereof becomes worn after lengthy service. To this end, the bearing portions 104 and 96 are arranged to engage equal axial lengths of the respective piston stem 98', 98 thereby ensuring the development of symmetrical wear patterns on the respective piston stem portions. That is, the axial lengths of bearing portions 104 and 96 are proportional with respect to the stroke of piston 70 to ensure that respectively axially opposed tip portions 13, 15 of respective stems 98, 98' are never slidably engated within respective bearing portions 96, 104 during piston reciprocation (FIG. 2). Accordingly, after extended use the tip portions 13, 15 will have a larger diameter than the respective slidably supported stem portions 98, 98' which will have sustained measurable wear, and symetrically located annular ledges (not shown) will thus have been developed therebetween whereby piston 70 may be reversed in its bore even after extended use without risk of mechanical interference between such annular ledges and the axially outward extremities of the bearing portions 104, 96.

Drill 10 includes a percussion case draining means 172 (FIGS. 2 and 3) employed in conjunction with annular wiper seals 174 encompassing piston stem portions 98, 98' intermediate the axial ends of each respective bore portion 96, 104. Limited fluid leakage past wipers 174 gradually accumulates adjacent the piston end portions as in cavity 176 and therefore, such cavities as 176 are suitably vented to preclude such fluid accumulations. In conjunction with each seal 174 an annular drain cavity 178 is formed in each bearing portion 96, 104 axially inwardly of the respective seals 174 for containing any fluid which leaks axially outward along the periphery of the stem portions 98, 98' from the respective chambers 110, 112. Such fluid leakage is drained from each of the annuli 178 via one or more generally radially extending passages 180 to an axially extending passage 182 in cylinder 72. Passage 182 communicates with an annular drain cavity 184 which extends radially inward and outward of bearing annulus 114 intermediate cylinder 72 and backhead 16, and includes at least one radially extending slot 186 communicating radially across annulus 114 between the radially inward and outward portions thereof. Cavity 184 is isolated from the radially inwardly adjacent cavity 176 by the axial face seal 118 between backhead 16 and buffer ring 102. A drain connection 188 is provided in backhead 16 for communicating a fluid drain line 190 from reservoir 156 into cavity 184 whereby a fluid flow path is established for dissipating fluid pressure and directing fluid leakage away from the axially inner sides of seals 174.

In general, fluid leakage in drill 110 could cause dangerously high pressures therewithin, for example on backhead 16, thereby precipitating catastrophic failure of the front or back heads 18, 16 or side rods 20. Accordingly, the inclusion of annular cavity 184 in the drain path as described precludes any pressure buildup therewithin by venting cavity 184 to reservoir 56 as part of the percussion case drain means 172. A similar provision may be utilized to preclude pressure buildup in the yoke housing 28 or between portions of the cylinder 72 and yoke 14.

The radial drain passage 180 communicating with the forward drain annulus 178 includes an axially elongated annular cavity 192 formed radially intermediate the liner 94 and cylinder 72 wherein fluid may accumulate to be tapped off for lubricating various portions of the drill. For example, a network of passages 194 (FIG. 2) communicates from annulus 192 through cylinder 72, yoke housing 28 and front head 18 to deliver fluid leakage from annulus 192 for lubrication of relatively rotatable forward end portions of the chuck 30 and front head 18.

A four way, open center valve 196 (FIG. 2) is interposed in fluid lines 134, 154 between the drill 10 and the pump 132 and reservoir 156 for controlling motive fluid flow to the drill 10. Valve 196 is selectively operable to a position A to connect pump 132 to inlet 130 and exhaust outlet 152 to reservoir 156, or to a position C for connecting pump 132 to exhaust outlet 152 and inlet connection 130 to reservoir 156 for a purpose to be described hereinbelow. Valve 196 additionally provides for a third position B (not necessarily intermediate the positions A and C) wherein motive fluid flows freely from pump 132 to all ports of valve 196 and back to reservoir 156 to equalize the fluid pressures in the drill inlet and exhaust chambers 76A, 76C. The position B provides a neutral or idle operating mode for such purposes as purging of air or impurities from the fluid in drill 10.

Figure 5:
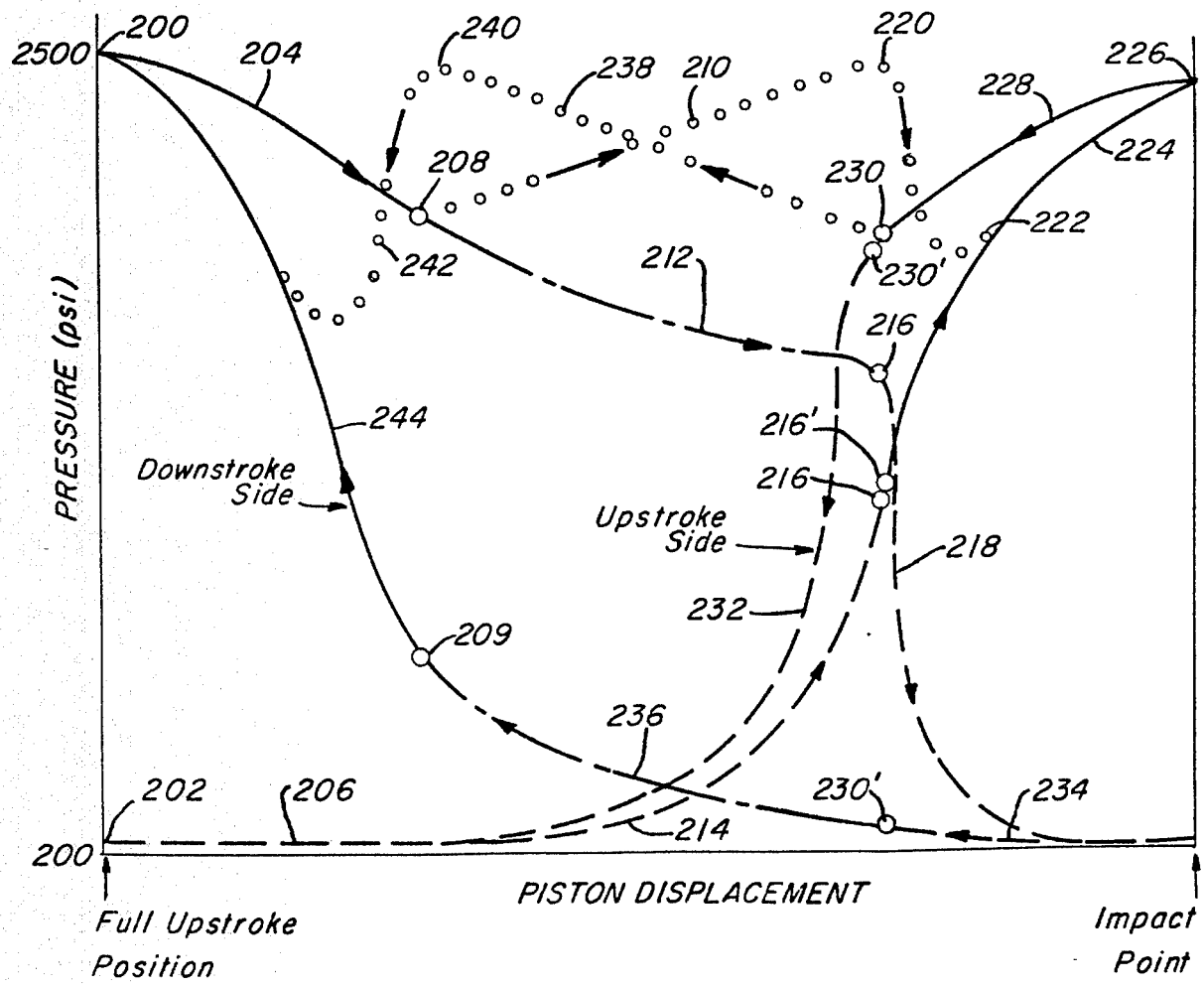
FIG. 5 is a diagram of the relationship between hydraulic fluid pressure on the piston head and piston position in its stroke.
Figure 6:
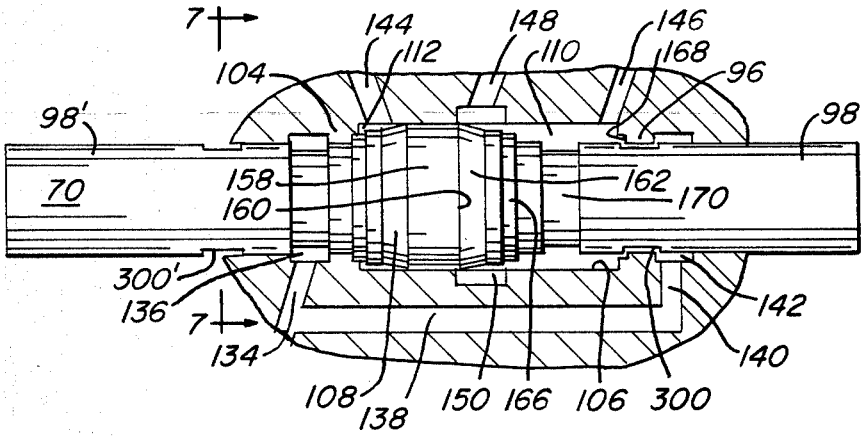
FIG. 6 is similar to FIG. 4 with the hammer piston being shown in the full upstroke position.
Figure 7:
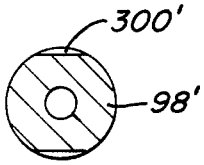
FIG. 7 is a cross sectional view of the hammer means of FIG. 6 taken along the lines 6—6 thereof.

Operation of drill 10 is illustrated in FIG. 5 by the relationship of fluid pressure in the driving chambers 110, 112 and the respective energy accumulators 76D, 76B to piston position in its reciprocal travel. As piston 70 reciprocates within bore 88 the upstroke and downstroke inlet grooves 170, 170' alternately communicate respective inlet annuli 142, 136 with respective upstroke and downstroke chambers 110, 112 and the associated accumulators 76D, 76B (hereinafter referred to respectively as the "upstroke side" and the "downstroke side" of the piston) to act upon the differential areas formed by the diameter differential between land 158 and respective stems 98, 98'. Likewise, during piston reciprocation land 158 alternately communicates axially opposed end portions of exhaust annulus 150 with the upstroke and downstroke sides of piston 70 to intermittently exhaust pressurized fluid therefrom. For illustrative clarity the piston displacement scale in FIG. 5 is greatly extended over the actual stroke of the piston in the described embodiment, which is a very short stroke on the order of $\frac{5}{8}$". Furthermore, the illustrated range of pressure values may be varied widely and is therefore not to be considered a limitation on the invention described.

Drill 10 is of the valveless or self-exciting type wherein grooves 170, 170' and land 158 of piston 70 cooperate with respective annuli 142, 136 and 150 to valve motive fluid to and from the upstroke side and downstroke side of the piston 70 in response to the position of piston 70 in its stroke. The respective inlet and exhaust ports thus formed provide fluid flow rate control over a continuous range from a fully open state to a fully closed state as indicated by continuously variable flow resistances $R_1$ through $R_4$ in FIG. 4. By virtue of peripheral clearances between piston 70 and bore 88 adjacent the respective inlet and exhaust ports a degree of fluid flow is maintained even when the ports are "closed" as at $R_1$ for example.

A balanced or equilibrium piston position illustrated as being to the upstroke side of the midstroke position (FIG. 4) is defined for the piston 70 whereat the upstroke and downstroke sides of piston head 108 are subjected to equal and opposite motive fluid forces. In terms of the indicated flow resistance the balanced position of piston 70 is defined as that position for which $R_1/R_2$ equals $R_3/R_4$. That is, the ratio of inlet pressure drop to exhaust pressure drop on the downstroke side of piston head 108 is equal to the ratio of inlet pressure drop to exhaust pressure drop on the upstroke side. In other words, the total pressure drop from inlet chamber 76A to exhaust chamber 76C is proportioned identically between the respective inlet and exhaust ports for both the upstroke side and the downstroke side of the piston. Since the total pressure drop from chamber 76A to chamber 76C is the same for any path therebetween, and since such pressure is identically proportioned between the respective inlet and exhaust ports on both the upstroke and downstroke sides of the piston head 108, the net effective pressure acting on either side of piston head 108 will be equal for the balanced piston position. There is no general requirement for equality among any of the flow resistances $R_1$ through $R_4$ at piston equilibrium so long as the indicated ratios hold. For example, assume hypothetically that $R_3$ exceeds $R_1$ and $R_4$ exceeds $R_2$ at the piston equilibrium position. It follows then that $R_3+R_4$ exceeds $R_1+R_2$ (the total flow resistance from inlet 76A to exhaust 76C is greater for the downstroke side than for the upstroke side) and thus a larger proportion of the total fluid flow from inlet to exhaust will pass through the upstroke side. Nevertheless, so long as the piston 70 resides at the equilibrium position such that $R_1/R_2$ equals $R_3/R_4$, equal net effective pressures will act on each side of the piston head 108 in spite of the unequal flows, and the piston 70 thus will not be urged in either the upstroke or the downstroke direction by fluid pressure.

The above-described relationship of flow resistance is not dependent upon the particular dimensions or form of piston 70 and linear assembly 90. In general the various porting land and groove widths, circumferential clearances, port spacing, taper angles and the like may be varied to provide the described flow resistance relationships to define a suitable piston equilibrium position.

An additional requirement that $R_4$ not be equal to $R_2$ for the equilibrium position provides for simplified drill startup as hereinbelow described. For initial operation, pump 132 is providing fluid at the full flow rate for the neutral operating mode with valve 196 in the B position whereby fluid circulates freely from pump 132 through valve 196 and back to reservoir 156, and additionally to both the inlet and exhaust chambers 76A, 76C to completely flood all fluid flow passages and equalize fluid pressure throughout drill 10. To begin piston reciprocation valve 196 is shifted from the B position to either the A or C position to port full motive fluid flow through drill 10. In the A position chamber 76A is pressurized by pump 132 and chamber 76C is exhausted to reservoir 156 whereby the piston 70, which in general will not reside at the hereinabove defined equilibrium position, will be urged toward its equilibrium position by the inlet-to-exhaust pressure differential. As an example, assume that the piston 70 initially is positioned in the upstroke direction from its equilibrium position with valve 196 in the A position. It follows that $R_1$ and $R_4$ are greater (ports more fully closed) and $R_2$ and $R_3$ are less (ports more fully open) than when pistion 70 is at equilibrium. Accordingly, $R_1/R_2$ will be greater than $R_3/R_4$ (the proportion of total pressure drop through the upstroke side inlet exceeds the proportion of total pressure drop through the downstroke side inlet) whereby net unopposed fluid pressure component acts on the downstroke side to urge piston 70 in the downstroke direction toward its equilibrium position. Similar considerations apply if piston 70 initially resides downstroke from its balanced position whereat $R_1/R_2$ is less than $R_3/R_4$ and an unopposed fluid pressure component thus acts on the upstroke side to urge piston 70 toward the equilibrium position. In either case as the piston 70 approaches equilibrium, the ratios $R_1/R_2$ and $R_3/R_4$ approach equality and the net unopposed fluid pressure component acting on piston head 108 approaches zero.

From the above analysis it will be clear that if piston 70 overtravels its equilibrium position from either direction under the impetus of an unopposed fluid pressure component, an oppositely directed fluid pressure component will be established to urge piston 70 back toward the equilibrium position. Such repetitive piston overtravel of the equilibrium position alternately in the upstroke and downstroke directions constitutes the normal self-exciting piston reciprocating mode. Therefore, when valve 196 is placed in the A position piston 70 may immediately begin self-excited reciprocation, in which case drill startup is completed, or may come to rest at the equilibrium position. Should this occur drill startup may be effected by shifting valve 196 to the C position to pressurize exhaust chamber 76C and connect inlet chamber 76A to reservoir 156. Inasmuch as $R_2$ and $R_4$ are not equal at the equilibrium position as hereinabove mentioned (in this case $R_4$ exceeds $R_2$), the initial fluid pressure surge from chamber 76C will more readily pressurize the upstroke side of piston head 108 thereby urging piston 70 further upstroke and away from equilibrium.

With chamber 76C pressurized and chambers 76A exhausted, the condition $R_1/R_2$ equals $R_3/R_4$ for piston equilibrium still applies. However, in this case it is a very precarious equilibrium wherein any deviation of piston 70 from equilibrium results in a net unopposed fluid pressure component in the direction of each deviation which increases with increasing deviation to urge the piston further from equilibrium. Accordingly, with valve 196 in the C position the initial pressure surge from chamber 76C urges piston 70 in the upstroke direction such that $R_1/R_2$ increases and $R_3/R_4$ decreases, and an unopposed fluid pressure component thus develops on the upstroke side to urge the piston from equilibrium. As the piston 70 deviates from equilibrium the upstroke fluid pressure component increases to urge piston 70 to the full upstroke position at which point $R_1/R_2$ greatly exceeds $R_3/R_4$. Accordingly, upon shifting valve 196 back to the A position a large unopposed fluid pressure component will act upon the downstroke side to urge piston 70 toward and past equilibrium whereby self-excited piston reciprocation is established as hereinabove described.

Once having been started the piston 70 will continue to self-excited reciprocation according to the cycle depicted in FIG. 5. Piston 70 begins its downward stroke from the full upstroke position 200 (left ordinate of FIG. 5) whereat the downstroke side is fully open to inlet chamber 76A and is pressurized to near peak inlet pressure, 2500 psi for example. The upstroke side is open to exhaust chamber 76C and is at the exhaust back pressure, for example 200 psi as shown at 202. Exhaust back pressure is maintained by the various flow restrictions between annulus 150 and reservoir 156, for example the changing cross sectional side of the exhaust passages 148, the length of fluid line 154 and so forth. The exhaust back pressure in conjunction with the hereinabove described piston tapers 160 prevents cavitation of pressurized fluid flowing to exhuast by maintaining a positive exhaust path fluid pressure at all times. As piston 70 begins to accelerate toward impact (to the right in FIG. 5) pressure on the downstroke side begins to fall along line 204 as the moving piston head 108 vacates chamber 112 to increase the volume thereof. Simultaneously the accelerating piston decreases the volume of chamber 110; however, because the exhaust remains open to the upstroke side during this cycle portion the fluid pressure in chambers 110 and 76D does not significantly increase, but remains essentially constant as indicated by line 206. As piston 70 reaches point 208 on line 204 in its downstroke the rearward edge of groove 170' passes the forward edge of annulus 136 and the inlet to the downstroke side closes ($R_3$ increases substantially). Thereafter the continued operation of pump 132 charges inlet chamber 76A up to peak pressure along line 210 during an inlet deadband portion of the cycle while the piston continues to accelerate under the impetus of fluid pressure energy stored on the downstroke side in chambers 112 and 76B. Because the volume of chamber 112 continues to increase as piston head 108 vacates it, the pressure of fluid therein and in communicating chamber 76B continues to drop along line 212. Simultaneously the fluid pressure on the upstroke side of the piston (chambers 110 and 76D) begins to rise along line 214 as the volume of chamber 110 continues to decrease before the encroaching piston head 108 and the exhaust area open to the upstroke side decreases (flow resistance $R_2$ increases).

At point 216 on line 212 land 158 is centered on annulus 150 ($R_4$ equals $R_2$) and thus upon further piston movement the exhaust chamber 76C is opened to the downstroke side and simultaneously closed to the upstroke side of piston head 108. Accordingly, the fluid pressure on the downstroke side drops rapidly along line 218 to the exhaust back pressure as the remaining fluid energy in chambers 112 and 76B is exhausted to chamber 76C. The indicated exhaust back pressure, although only a fraction of the peak driving pressure, continues driving the piston toward impact. Also substantially simtaneously with or very shortly after 216 in the cycle as at 216' the inlet deadband cycle portion ends as chamber 76A is opened to the upstroke side to charge inlet fluid pressure energy into chambers 110 and 76D whereupon the pressure in chamber 76A drops from its peak value 220 and subsequently equalizes with the upstroke side pressure at 222. As the volume of chamber 110 further decreases and charging of fluid into the upstroke side continues the fluid pressure in the upstroke side rises along line 224 toward its peak value as the piston impacts upon the striking bar 42, indicated at 226 on the right ordinate of the FIG. 5.

The axial position of piston 70 at impact is not a fixed parameter of the drill but may be varied over a comparatively broad range of locations because during the piston downstroke, chamber 76D absorbs much of the energy input generated by piston head 108 movement into chamber 110 and the pressure fluid inflow from chamber 76A thereby reducing the net fluid pressure resistance to further piston downstroke travel. Such fluid pressure resistance, if not reduced, would otherwise dissipate a significant part of the piston kinetic energy before impact and render the drill substantially more sensitive to impact point location. Storage of fluid pressure energy in chamber 76D during the piston downstroke also provides an extended dwell time or contact period between piston 70 and striking bar 42 during impact for more efficient impact energy transmission, and additionally provides an initial store of energy for accelerating the piston in the upstroke direction after impact.

As the cycle continues, the piston rebounds from striking bar 42 and begins to accelerate toward its full upstroke position under the impetus of the fluid energy in chamber 76D and simultaneously supplied from chamber 76A through the open inlet to the upstroke side. As piston head 108 vacates chamber 110 to increase the volume thereof the pressure therein drops along line 228 to point 230 whereupon the inlet to the upstroke side closes. Substantially simutaneously or if desired very shortly thereafter as at 230', exhaust chamber 76C is opened to the upstroke side and closed to the downstroke side, and accordingly the upstroke side pressure drops sharply along line 232 as the remaining fluid energy in chambers 110 and 76D is exhausted. Chambers 112 and 76B which have been gradually pressurized along line 234 to point 230' during the upstroke are further pressurized along line 236 as the piston head 108 encroaches upon chamber 112 through the inlet deadband cycle portion. Also during the inlet deadband portion inlet chamber 76A is again pressurized by flow from pump 132 along line 238 to peak inlet pressure at 240. As the piston reaches point 209 in its upstroke, which is the end of the inlet deadband portion, the pressure fluid inlet opens to the downstroke side to once again charge pressure fluid thereinto from chamber 76A, the pressure in which falls off along line 242 and equalizes with the downstroke side pressure which continues increasing along line 244. Fluid pressure on the upstroke side, which remains open to exhuast chamber 76C, continues to decrease along line 232 to the exhaust back pressure as the piston 70 travels to the full upstroke position. Under the impetus of fluid pressure accumulated within chambers 76A, 110 and 76B, the piston decelerates to a stop at the full upstroke position thereof with peak inlet pressure refusing further upstroke movement as indicated at 200, and immediately accelerates toward another impact to begin another cycle.

The explanation hereinabove of piston startup and cycling represents the inventor's best understanding of some of the applicable theoretical considerations and is not to be construed as the complete, final or authoritative explanation of the physical laws governing operation of this invention.

The description hereinabove discloses an improved hammer for a rock drilling apparatus of simplified and compact design, and having means to easily start piston reciprocation from a neutral position thereof, and to prevent fluid cavitation and an improved self-exciting hammer piston cycle which provides for improved impact energy transfer efficiency.

As heretofore described piston 70 achieves self-excited reciprocation by placing the valve 196 in the A position or, under the circumstances described, by placing the valve 196 in the C position and thereafter in the A position. Such reciprocation is obtained when the hydraulic fluid for the drill operating is sufficiently viscous to provide fluid at a rate to maintain self-excited reciprocation. In instances wherein the fluid is not at a viscosity to immediately maintain self-excited oscillation, repeated movement of the valve 196 from the A to C and then the A positions will cause the piston 70 to seek its equilibrium position since the fluid flow energy losses are greater than the forces available to permit self-excited reciprocation of the piston 70. As shown, such starter port means comprises a pair of diametrically opposed axially extending upon sided slots 300 and 300' having an axial length greater than the axial length of lands or bore portions 96 and 104. The ends of each opposed pair of slots are in lateral alignment with respect to the central axis of piston. Each pair of slots 300 and 300' are axially located on stem portions 98, 98', respectively, so that with the piston 70 in the equilibrium position of FIG. 4, the slots 300' are located axially outwardly of the inlet annulus 136 and the slots 300 are located axially outwardly of the inlet annulus 142. The slots 300 have their axially inward ends located such that when the piston 70 in either its full upstroke position or substantially its full upstroke position, the axially inward end portions of slots 300 are in fluid flow communication with the upstroke chamber 110 through cavity 168 and the axially outward end portions of slots 300 are in fluid flow communication with the inlet annulus 142. Similarly, with the piston 70 in either its full or substantially its full downstroke position the axially inward end portions of slots 300' are in fluid flow communication with the downstroke chamber 112 and the axially outward end portions of the slots 300' are in fluid flow communication with the inlet annulus 136.

Figure 4:
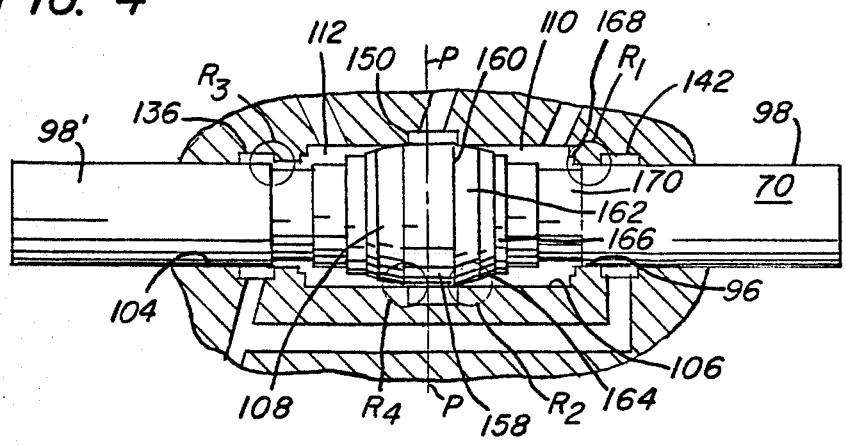
FIG. 4 is a fragmentary portion of the hammer means of FIG. 1 showing the hammer piston in detail.

With the piston 70 in the equilibrium position of FIG. 4 upon start up, when the operating fluid at a temperature such that the fluid is at a viscosity so as not to immediately sustain self-excited reciprocation of piston 70 and with valve 196 in the A position, pump 132 will circulate fluid as heretofore described, through the upstroke and downstroke chambers 110, 112. In instances when the fluid is very cold, such as when the drill stands overnight in below zero degree Fahrenheit temperature, the initial flow of fluid will be quite slow due to the high viscosity of the fluid. Such slow fluid flow, if continued for a period of time, will eventually cause the temperature of the fluid to increase and the viscosity of the fluid to decrease so that the piston can be self excited. Such slow warm up of fluid is undesirable and, by shifting the valve 196 to the C position, the fluid will move the piston 70 from the equilibrium position of FIG. 4 to its full or substantially full upstroke position due to the pressurized fluid in chamber 110 acting on the upstroke side of piston head portion 108 as heretofore described. Such upstroke positioning of piston 70 places the slots 300 in their upstroke position whereat the slots 300 bridge the segment of bearing portion 96 axially inward of annulus 142 to place the chamber 110 in fluid flow communication with annulus 142. Slots 300 are effective to reduce the resistance $R_1$ to permit a selected rate of pressurized fluid flow through a sequential path from the reversed flow supply annulus 150 to chamber 110, slots 300, annulus 142, bores 140, passages 138, bores 134, line 134' to tank or reservoir 156. It is to be realized that such sequential path is the established path for fluid flow; however, fluid in portions of the drill, such as bores 146 and chamber 76D, in fluid flow communication with such sequential path will intermix with the fluid flowing in such path. Such intermixing of fluid portions within the drill will particularly occur as the piston 70, linear assembly 90 and cylinder 72 are heated as the fluid temperature within the drill increases. After there has been a sufficient warming of the hydraulic fluid the valve 196 is shifted to the A position to obtain self-excited reciprocation of the piston 70. When so shifting to the A position and prior to movement of the piston 70, the slots 300 are still in fluid flow communication with the upstroke chamber 110 and the normal supply annulus 142 and chamber 110 remains in fluid flow communication with the normal discharge annulus 150. Consequently slots 300 must provide a sufficient resistance to fluid flow when the normal supply of fluid is established upon shifting from the C to the A positions to prevent having a low resistance fluid flow path directly to discharge through discharge annulus 150. In addition to initiate self-excited reciprocation of piston 70 upon shifting the valve 196 to the C position, the pressure of the hydraulic fluid supplied to the downstroke chamber 112 must be sufficient to drive the piston 70 through the downstroke. It is also to be recognized that the higher the resistance offered by slots 300 to fluid flow during fluid warmup will increase the time period to obtain fluid warmup. Since the purpose of obtaining fluid warmup is subservient to obtaining self-excited reciprocation, the slots 300 are of a size to provide the maximum fluid flow rate which still provides the requisite fluid pressure in chamber 112 to drive piston 70 through the downstroke. In practice with a pump 132 capable of discharging fluid at 3000 psi a pressure drop of 1500 psi through the slots 300 has proven to be satisfactory.

With the described pump 132, piston 70 and slots 300 as used in a commerical design, a warmup time of substantially ten degrees Fahrenheit (10° F.) per minute has been obtained with the piston 70 being reciprocatable when the fluid within the drill is at forty degrees Fahrenheit (40°). Such warmup time is obviously only an illustrative practical example.

Although the fluid warmup cycle has been described with relation to the piston 70 initially being in the equilibrium position under operating conditions, it is not always possible to initiate fluid warmup with the piston 70 being in the equilibrium position. Accordingly, the starting slots 300' have been provided to obtain fluid warmup when the piston 70 is located in its full or substantially full downstroke position as may reasonably occur when a drill is left standing overnight in a vertically extending position. With piston 70 in such downstroke position, the slots 300' are located with relation to the axially inward segment of bearing portion 96' immediately adjacent the normal inlet annulus 136 to provide for fluid warmup by fluid flow through chamber 112 in the same manner as slots 300 are located with relation to the inner segment of bearing portion 96 and provide the desired fluid flow through chamber 110. Accordingly, further description of the functioning of slots 300' is not necessary for one skilled in the relevant art. Once fluid warmup has occurred, shifting of valve 196 to the A position will cause the piston 70 to initiate self-excited reciprocation. Since slots 300 and 300' are only effective when the piston 70 is in its full or substantially full upstroke or downstroke position the slots 300 and 300' have no function during the reciprocation of the piston 70 in normal operation.

Although a pair of opposed slots 300 and 300' has been described, it will be appreciated that any means for permitting pre-reciprocation fluid flow as described is satisfactory. For example, annular grooves may be provided in portions 98 and 98' in place of the 300 and 300' slots or a suitable combination of slots less than a full groove may be utilized. Further, either pair of slots can be circumferentially offset from the other pair of slots.

Notwithstanding the disclosure of a particular preferred embodiment of the invention, it is to be understood that the invention is susceptible of various alternative embodiments and numerous modifications without departing from the broad spirit and scope thereof. For example: the yoke portion and fluid circuit means may take any of various suitable forms; the relative sizes of the various accumulator chambers may be varied as by packing portions thereof with arcuate plates (not shown); the piston may comprise any of a wide variety of reversible or nonreversible symmetrical or asymmetrical designs, and particularly reversible asymmetrical designs wherein reversing the piston in its bore provides a modified operating cycle; various alternative porting arrangments offering modified operating cycles within the scope of the invention may be employed such as a cycle including a short positive exhaust deadband portion during which chamber 76C is isolated from both the upstroke and downstroke sides of piston head 108, or a short negative deadband portion during which chamber 76C is open to both the upstroke and downstroke sides; the upstroke side and downstroke side piston differential areas are not necessarily equal; and the like. These and other embodiments and modifications having been envisioned and anticipated by the inventor, the invention should be interpreted broadly and limited only by the scope of the claims appended hereto.

What is claimed is:

1. A hydraulic drive for actuating a tool comprising: a body member having an elongated bore therein with a central longitudinal axis and with one end of said bore being adapted to receive at least a portion of an actuatable tool structure internally thereof; an elongated piston axially reciprocal within said bore to deliver impact blows to such a tool structure; said bore having an axially intermediate chamber section of greater cross-sectional extent than the cross-sectional extent of the adjacent sections of said bore axially outwardly thereof; said piston having a formed axially intermediate head section; said head section having axially extending outer peripheral surface closely slideably received within said chamber section to define chamber portions within said chamber section on axially opposite sides of said central portion of said head section which chamber portions vary inversely in volume as said piston reciprocates; first passageway means in said body member having axially spaced fluid inlet port means in communication with said bore axially outwardly of said chamber section, respectively, said piston having formed axially spaced means cooperable with said port means, respectively, for selective admission of hydraulic fluid to said chamber portions alternately; second passageway means in said body member having a discharge port means with an axial extent in communication with said chamber section; said outer peripheral surface having the axially spaced ends thereof cooperable with said axial extent of said discharge port means to control the discharge of hydraulic fluid from said chamber portions; said head section having formed portions extending axially outwardly from the ends of said axially extending outer peripheral surface respectively, and said formed portions being of a configuration to uniformly increase the flow of hydraulic fluid through said discharge port means and said second passageway means after an initiation of flow therethrough during reciprocation of said piston.

2. A hydraulic drive as set forth in claim 1 wherein said formed portions are coaxial with said head section.

3. A hydraulic drive as set forth in claim 1 wherein said formed portions extend axially outwardly from said head section and are tapered at an angle with respect to the central longitudinal axis of said piston with the smaller end of each of said formed portions being axially spaced from said head section.

4. A hydraulic drive as set forth in claim 3 wherein said taper is at an angle in the range of 5 to 15 degrees.

5. A hydraulic drive as set forth in claim 1 wherein said piston reciprocates through an axial work stroke in impacting such tool structure less than the axial extent of said chamber section, and said piston having means for placing at least one of said chamber portions in fluid flow communication with one of said inlet port means when said piston is located beyond said work stroke in one selected end of said chamber portion.

6. A hydraulic drive comprising: a body member having an elongated bore therein with a longitudinally extending central axis; said bore having an axially extending chamber section intermediate axially extending end sections of smaller cross section; an enlongated piston having a head portion intermediate axially extending end portions of smaller cross section; said piston being reciprocable within said bore with said head portion being closely received within said chamber section and forming chamber portions on axially opposite sides of said head portion and with said piston end portions being closely received within said end sections of said bore; said body member having first fluid passageway means having termination portions in open communication with said bore at locations spaced axially outwardly of the ends of said chamber section, respectively; said body member having second fluid passageway means having a termination portion in open communication with said chamber section; said end portions of said piston having first integral means cooperable with said termination portions of said first passageway means, respectively, to control the admission of pressurized fluid from said first fluid passageway means to said chamber portions for reciprocating said piston through an axial stroke intermediate and less than the axial extent of said chamber section; at least one of said end portions of said piston having second integral means located axially outward of said first integral means thereon for placing the one of said chamber portions closest thereto in fluid communication with said first fluid passageway means when said piston is located beyond the end of said axial stroke within the other of said chamber portions; and said second fluid passageway means being in fluid flow communication with said closest one chamber portion when said piston is located beyond said end of said axial stroke.

7. A hydraulic drive as set forth in claim 6 wherein the other of said end portions of said piston has third integral means located axially outward of said first integral means thereon for placing the other of said chamber portions in fluid communication with said first passageway means when said piston is located beyond the end of said axial stroke within said one of said chamber portions; and said second fluid passageway means being in fluid flow communication with said other chamber portion when said piston is located beyond said end of said stroke within said one of said chamber portions.

8. A hydraulic drive as set forth in claim 7 wherein said second and third integral means are identical in configuration.

9. A hydraulic drive as set forth in claim 6 wherein said second integral means is of a configuration to cause a selected pressure drop in the flow of fluid therethrough.

10. A hydraulic drive as set forth in claim 7 wherein said second and said third integral means are each of a configuration to cause a selected pressure drop in the flow of fluid therethrough.

11. A hydraulic drive as set forth in claim 6 wherein said first passageway means and second passageway means are connected to a fluid flow control mean adapted to selectively connect either one of said passageway means to a source of pressurized fluid with the other of said passsageway means being a discharge passageway.

* * * * *